US009568234B2

(12) United States Patent
Jeong et al.

(10) Patent No.: US 9,568,234 B2
(45) Date of Patent: Feb. 14, 2017

(54) REFRIGERATOR

(71) Applicant: SAMSUNG ELECTRONICS CO., LTD., Suwon-si (KR)

(72) Inventors: Jin Jeong, Yongin-si (KR); Sung Cheol Kang, Gwangju (KR); Do Hyung Kim, Yongin-si (KR); Sang Hyun Park, Seongnam-Si (KR); Kook Jeong Seo, Suwon-si (KR); Jae Koog An, Gwangju (KR); Yong Sung Yoon, Gwangju-si (KR); Jae Jin Lee, Gwangju (KR); Seung Ah Joo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 43 days.

(21) Appl. No.: 14/608,338

(22) Filed: Jan. 29, 2015

(65) Prior Publication Data

US 2015/0135760 A1 May 21, 2015

Related U.S. Application Data

(63) Continuation of application No. 13/734,162, filed on Jan. 4, 2013, now Pat. No. 8,973,392.

(30) Foreign Application Priority Data

Jan. 6, 2012 (KR) ..... 10-2012-0002142

(51) Int. Cl.
*F25C 5/18* (2006.01)
*F25D 23/08* (2006.01)

(52) U.S. Cl.
CPC ..... *F25C 5/182* (2013.01); *F25D 23/087* (2013.01)

(58) Field of Classification Search
CPC ..... F25D 23/087; F25C 2/002; F25C 5/0046; F25C 2400/10; F25C 1/24; F25C 5/16; F25C 5/046
(Continued)

(56) References Cited

U.S. PATENT DOCUMENTS 4,822,117 A * 4/1989 Boston, Jr. ..... F25D 23/062 29/455.1
4,909,039 A 3/1990 Yamada et al.
(Continued)

FOREIGN PATENT DOCUMENTS

KR 10-2009-0107879 10/2006
KR 10-0765200 10/2007
KR 10-2009-0075017 7/2009

OTHER PUBLICATIONS

Notice of Patent Allowance issued Jan. 28, 2015 in corresponding Korean Patent Application 10-2012-002142.
(Continued)

*Primary Examiner* — Mohammad M Ali
(74) *Attorney, Agent, or Firm* — Staas & Halsey LLP

(57) ABSTRACT

A locking apparatus of an ice bucket of a refrigerator capable of simplifying the structure of the ice bucket while preventing the cool air of the ice making compartment from leaking and the ice bucket from being shaken, the refrigerator including a locking apparatus accommodating portion formed at a lower portion of the ice making compartment, a lever hingedly coupled to the locking apparatus accommodating portion, and an elastic member configured to elastically bias the lever, wherein the lever is configured to interfere with a locking projection of the ice bucket, and a button portion configured to adjust the position of the locking protrusion by rotating the lever, wherein a gasket mounting portion formed around an opening portion of the ice making compartment is formed to be extended to the
(Continued)

inner side of the ice making compartment to make contact with the gasket mounting portion in a two-area contact manner.

6 Claims, 8 Drawing Sheets

(58) Field of Classification Search
USPC ..... 62/344, 341
See application file for complete search history.

(56) References Cited

U.S. PATENT DOCUMENTS 5,605,047 A * 2/1997 Park ..... F25B 21/02 62/3.6
5,934,098 A * 8/1999 Lee ..... E05C 19/161 312/401
5,946,924 A 9/1999 Kim
6,094,934 A * 8/2000 Rand ..... A47F 3/0408 312/116
7,240,511 B2 * 7/2007 Lee ..... F25D 17/045 62/353
7,594,413 B2 9/2009 Martin et al.
7,870,754 B2 1/2011 Martin et al.
2004/0107721 A1 6/2004 Choi et al.
2005/0183441 A1 * 8/2005 Lee ..... F25D 17/045 62/340
2006/0090401 A1 * 5/2006 Berry ..... E06B 3/80 49/409
2006/0097127 A1 5/2006 Firth
2006/0225454 A1 10/2006 Athanasiou
2006/0260343 A1 11/2006 Martin et al.
2008/0156022 A1 7/2008 LeClear et al.
2008/0209938 A1 * 9/2008 Lee ..... F25C 1/04 62/340
2008/0236188 A1 * 10/2008 Lee ..... F25C 1/04 62/344
2010/0126202 A1 * 5/2010 Flores ..... F25C 5/007 62/344
2010/0229589 A1 9/2010 Lee et al.
2010/0251747 A1 10/2010 Lee
2010/0319385 A1 12/2010 Hashimoto
2011/0023510 A1 2/2011 Lee
2011/0146326 A1 * 6/2011 Choi ..... F25C 5/18 62/344

OTHER PUBLICATIONS

Korean Office Acton issued Nov. 26, 2014 in corresponding Korean Patent Application 10-2012-0002142.
U.S. Notice of Allowance mailed Oct. 30, 2014 in related U.S. Appl. No. 13/734,162.

* cited by examiner

REFRIGERATOR

CROSS-REFERENCE TO RELATED APPLICATIONS

This application is a continuation of U.S. application Ser. No. 13/734,162, filed Jan. 4, 2013, which claims the priority benefit of Korean Patent Applications No. 10-2012-0002142, filed on Jan. 6, 2012 in the Korean Intellectual Property Office, the disclosure of which is incorporated herein by reference.

BACKGROUND

1. Field

Embodiments of the present disclosure relate to a fixing structure and a sealing structure of an ice bucket of an ice making compartment of a refrigerator.

2. Description of the Related Art

In general, a refrigerator refers to a home appliance provided with a storage compartment configured to store foods and a cool air supply apparatus configured to supply the storage compartment with cool air to keep the foods fresh. The refrigerator may be provided with an ice making compartment that is partitioned from the storage compartment, and an ice maker is provided at an inside the ice making compartment.

The ice making compartment is provided with an ice bucket configured to store the ice being generated from the ice maker, and the ice bucket may be slidably inserted into or withdrawn from the ice making compartment through an open front surface of the ice making compartment.

In addition, the refrigerator may be provided with a locking apparatus configured to lock the ice bucket such that the ice bucket is prevented from being withdrawn to the outside the ice making compartment. Examples of the locking apparatus of the ice bucket are disclosed in U.S. Pat. No. 7,594,413 and U.S. Pat. No. 7,870,754. However, according to the examples of the locking apparatus, the ice bucket locking apparatus is provided at the ice bucket, thereby complicating the structure thereof.

An ice making compartment cover portion is provided at a front end portion of the ice bucket to cover the open front surface of the ice making compartment. The ice making compartment cover portion is provided with a gasket configured to seal the ice making compartment while making contact with a front side of the ice making compartment.

SUMMARY

Therefore, it is an aspect of the present disclosure to provide a locking structure of an ice bucket capable of simplify the structure of the ice bucket.

It is another aspect of the present disclosure to provide a gasket structure of an ice bucket capable of preventing cool air from leaking by sealing the ice making compartment while preventing the ice bucket from being shaken.

Additional aspects of the disclosure will be set forth in part in the description which follows and, in part, will be apparent from the description, or may be learned by practice of the disclosure.

In accordance with one aspect of the present disclosure, a refrigerator includes a body, a storage compartment, an ice making compartment, an ice maker an ice bucket and a locking apparatus. The storage compartment may be provided at an inside the body. The ice making compartment may be configured to be partitioned from the storage compartment at an inside the body. The ice maker may be provided at an inside the ice making compartment to generate ice. The ice bucket may have an ice storage space configured to store the ice being generated from the ice maker, and may be configured to be inserted into an inside the ice making compartment or withdrawn to an outside the ice making compartment. The locking apparatus may be configured to lock the ice bucket such that the ice bucket is prevented from being withdrawn to the outside the ice making compartment. A locking projection may protrude from a lower portion of the ice bucket. The locking apparatus may include a locking apparatus accommodating portion, a cover, a lever and an elastic member. The locking apparatus accommodating portion may be formed at a lower side wall of the ice making compartment while having a lower surface configured to be open. The cover may be configured to cover the open lower surface of the locking apparatus accommodating portion. The lever may be rotatably hinged to the locking apparatus accommodating portion, and may be provided at one end portion thereof with a locking protrusion that is configured to interfere with the locking projection so as to lock the ice bucket. The elastic member may be configured to elastically bias the lever such that the locking protrusion interferes with the locking projection. The lever may be provided at the other end portion thereof with a button portion configured to press the lever such that the lever is rotated.

The button portion may be exposed to an outside of the cover.

As the button portion is pressed, the locking protrusion may rotate on a rotating shaft of the lever so as to be released from being interfered with the locking projection.

The cover may be provided with an opening portion that allows the button portion to pass therethrough.

The lower side wall of the ice making compartment may be provided with an opening portion that allows the locking protrusion to pass therethrough.

The elastic member may be a torsion spring mounted on the rotating shaft of the lever.

The locking projection and the locking protrusion may have inclination surfaces, respectively, that are slid against each other while making contact with each other when the ice bucket is inserted to the inside the ice making compartment.

In accordance with another aspect of the present disclosure, a refrigerator includes a body, a storage compartment, an ice making compartment, an ice maker and an ice bucket. The storage compartment may be provided at an inside the body. The ice making compartment may be configured to be partitioned from the storage compartment at an inside the body while being provided at a front surface thereof with an opening portion. The ice maker may be provided at an inside the ice making compartment to generate ice. The ice bucket may include an ice storage space configured to store the ice being generated from the ice maker, and a gasket configured to seal the ice making compartment. A gasket mounting portion on which the gasket is mounted may be formed around the opening portion of the ice making compartment. The gasket may make contact with the gasket mounting portion in a two-area contact manner.

The gasket mounting portion may be configured to extend from an outer surface of the ice making compartment to an inner side of the ice making compartment.

The gasket mounting portion may include a first plane that is bent from the outer surface of the ice making compartment to the inner side of the ice making compartment, and a second plane that is bent from the first plane and configured to form a step with respect to the outer surface. The gasket may make contact with the first plane and the second plane.

The ice bucket may include an ice making compartment cover portion configured to cover the opening portion of the ice making compartment. The ice making compartment cover portion may be provided at a rear surface thereof with a mounting protrusion on which the gasket is mounted.

The gasket may be mounted on the mounting protrusion in a manner to surround the mounting protrusion.

In accordance with another aspect of the present disclosure, a refrigerator having an ice making compartment and an ice bucket configured to be inserted to an inside the ice making compartment or withdrawn to an outside the ice making compartment includes a locking projection, a locking protrusion, an elastic member, and a button portion. The locking projection may be formed at a lower portion of the ice bucket. The locking protrusion may be configured to interfere with the locking projection to prevent the ice bucket from being withdrawn to the outside the ice making compartment. The elastic member may be configured to elastically bias the locking protrusion such that the locking protrusion interferes with the locking projection. The button portion may be provided at a lower portion of the ice making compartment so as to release the locking protrusion from being locked with the locking projection.

As described above, according to embodiments of the present disclosure, the locking apparatus of the ice bucket is provided at a lower side of the ice making compartment other than at the ice bucket, thereby simplifying the structure of the ice bucket and reducing a change in which the ice bucket is broken.

In addition, the gasket of the ice bucket makes contact with the gasket mounting portion, which is provided at the front side of the ice making compartment, in a two area contact manner, thereby effectively preventing the cool air from leaking at the ice making compartment and also preventing the ice bucket from being shaken.

BRIEF DESCRIPTION OF THE DRAWINGS

These and/or other aspects of the disclosure will become apparent and more readily appreciated from the following description of embodiments, taken in conjunction with the accompanying drawings of which.

DETAILED DESCRIPTION

Figure 1:
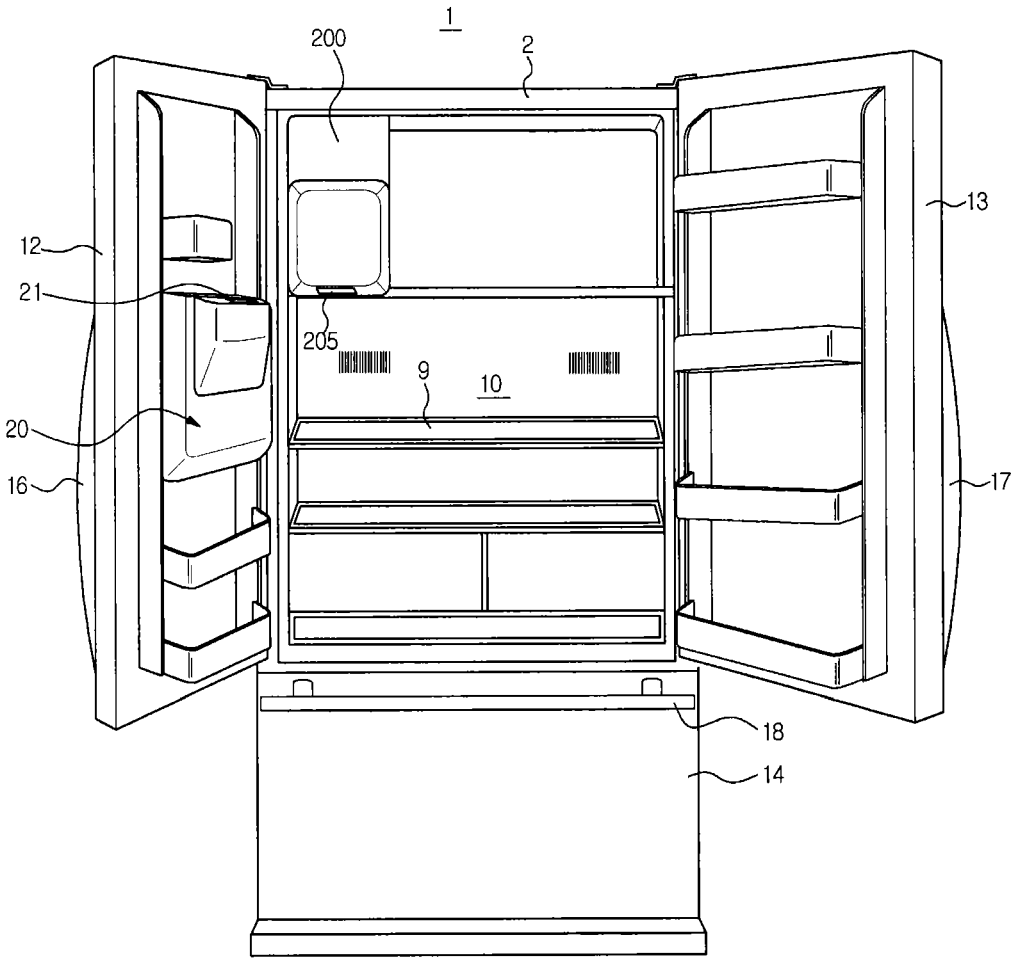
FIG. 1 is a front view illustrating a refrigerator in accordance with an embodiment of the present disclosure.

Reference will now be made in detail to embodiments of the present disclosure, examples of which are illustrated in the accompanying drawings, wherein like reference numerals refer to like elements throughout.

Figure 2:
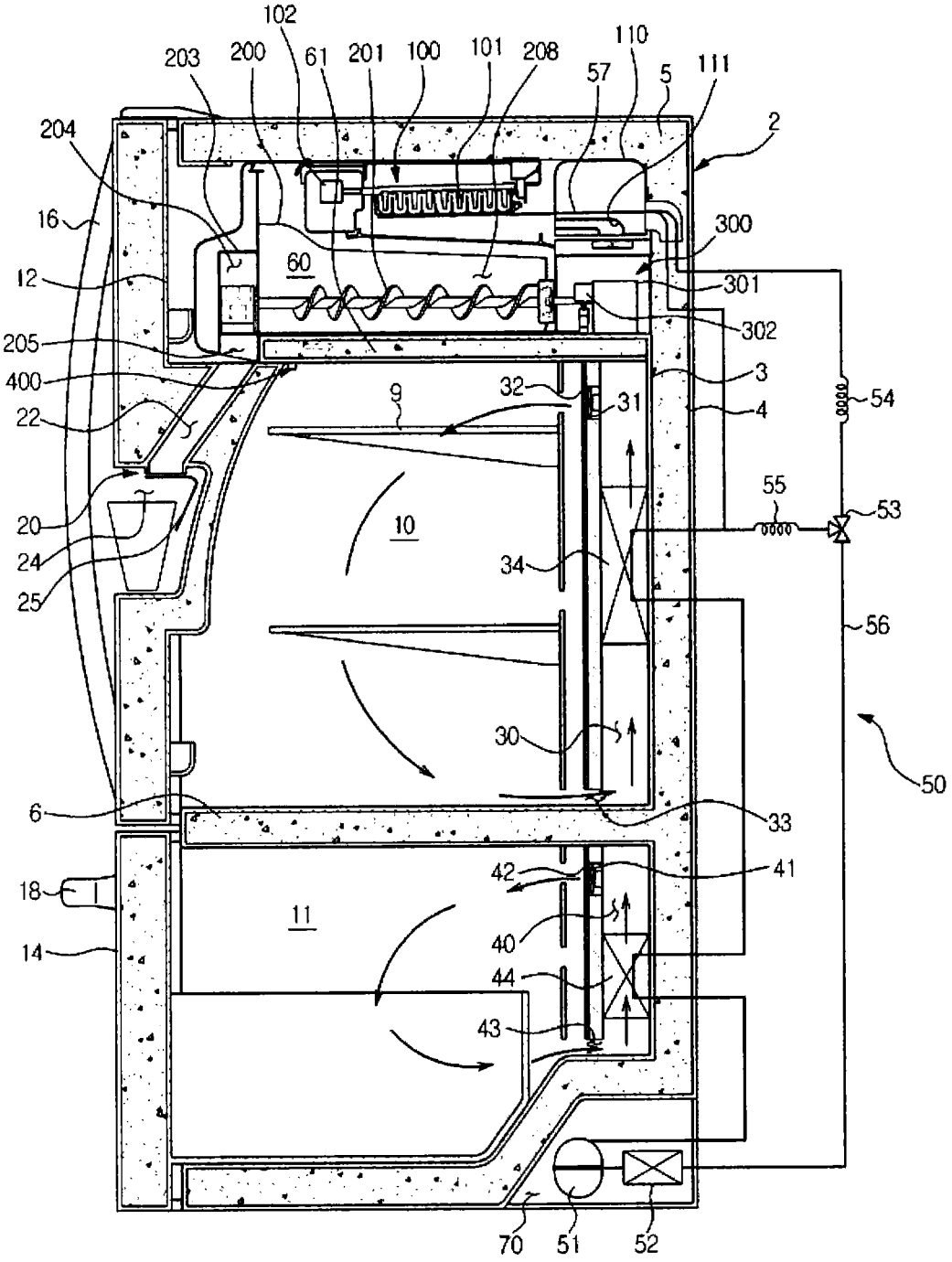
FIG. 2 is a cross sectional view illustrating the refrigerator of FIG. 1.

FIG. 1 is a front view illustrating a refrigerator in accordance with an embodiment of the present disclosure. FIG. 2 is a cross sectional view illustrating the refrigerator of FIG. 1.

Referring to FIGS. 1 and 2, a refrigerator 1 in accordance with an embodiment of the present disclosure includes a body 2, storage compartments 10 and 11 to keep food frozen or cooled, an ice making compartment 60 to generate ice, and a cool air supply apparatus 50 to supply the ice making compartment 60 with cool air.

The body 2 includes an outer case 4 forming the external appearance of the body 2, an inner case 3 forming the storage compartments 10 and 11, and an insulation material 5 foamed between the outer case 4 and the inner case 3.

The storage compartments 10 and 11 have front surfaces being open. The storage compartment 10 and 11 are divided by a horizontal partition wall 6 into a refrigerating compartment 10 and a freezing compartment 11 at the upper portion and the lower portion, respectively. The horizontal partition wall 6 may include insulation material to block the heat exchanged between the refrigerating compartment 10 and the freezing compartment 11.

The refrigerating compartment 10 may be provided with at least one shelf 9 on which food is placed and which serves to vertically partition a storage space of the refrigerating compartment 10. The open front surface of the refrigerating compartment 10 may be open and closed by a pair of doors 12 and 13 that is hingedly coupled to the body 2 so as to enable rotation. Handles 16 and 17 are provided at the doors 12 and 13, respectively, to open and close the doors 12 and 13.

A dispenser 20 is provided at the doors 12 and 13 such that ice being generated from the ice making compartment 60 is taken out from the outside without opening the doors 12 and 13. The dispenser 20 includes a take-out space 24 to take out ice, a lever 25 to select whether ice is to be taken output, and a chute 22 to guide the ice being discharged through a discharge hole 205 of an ice bucket 200, which is to be described later, toward the take-out space 24.

The open front surface of the freezing compartment 11 may be open and closed by a sliding door 14 available to be inserted into the freezing compartment 11 in a sliding manner. A rear surface of the sliding door 14 is integrally formed with a storage box on which food is contained. The sliding door 14 is provided with a handle 18 to open and close the sliding door 14.

Referring to FIG. 2, the refrigerator 1 includes the cool air supply apparatus 50 configured to supply the storage compartments 10 and 11 and the ice making compartment 60 with cool air. The cool air supply apparatus 50 includes a compressor 51 to compress refrigerant into a high pressure refrigerant, a condenser 52 to condense the compressed refrigerant, expansion apparatuses 54 and 55 to expand the refrigerant into a low pressure refrigerant for easy evaporation, evaporators 34 and 44 to generate cool air by evaporating the refrigerant, and a refrigerant pipe 56 to guide the refrigerant.

The compressor 51 and the condenser 52 are disposed at a machine room 70 being provided at a lower portion of a rear side of the body 2. In addition, the evaporators 34 and 44 are disposed at a refrigerating compartment cool air supply duct 30 provided at the refrigerating compartment 10 and at a freezing compartment cool air supply duct 40 provided at the freezing compartment 11. Accordingly, the refrigerating compartment 10 and the freezing compartment 11 may be cooled independent of each other.

The refrigerating compartment cool air supply duct 30 includes a suction port 33, a cool air discharge port 32, and a blower fan 31, to circulate the cool air at the inside the refrigerating compartment 10. In addition, the freezing compartment cool air supply duct 40 includes a suction port 43, a cool air discharge port 42 and a blower fan 41, to circulate the cool air at the inside the freezing compartment 11.

A portion of the refrigerant pipe 56 is disposed to be extended to the inside the ice making compartment 60 to cool the ice making compartment 60. Hereinafter, the portion of the refrigerator pipe 56 disposed at the inside the ice making compartment 60 as such is referred as the ice making compartment refrigerant pipe 57.

The refrigerant pipe 56 is diverged at one point thereof such that a refrigerant flows to the ice making compartment 60, the refrigerating compartment 10 and the freezing compartment 11 in a sequential manner, or flows only to the refrigerating compartment 10 and the freezing compartment 11 except for the ice making compartment 60. In addition, a switching valve 53 may be installed at the diverged portion of the refrigerant pipe 56 to switch the path of refrigerant. In addition, the refrigerant pipe 57 disposed at the inside the ice making compartment 60 makes a direct contact with an ice making tray 101 of an ice maker 100 to directly supply the cooling energy.

The ice making compartment 60 is provided to be partitioned from the storage compartments 10 and 11 at the inside the body 2. In addition, the ice making compartment 60 has a front surface configured to be open. The open front surface of the ice making compartment 60 is closed by an ice making compartment cover portion (240 in FIG. 7) of the ice bucket 200.

The ice making compartment 60 is provided at an upper portion of one side of the refrigerating compartment 10 while being partitioned from the refrigerating compartment 10 by an ice making compartment wall 61. The ice making compartment wall 61 may include insulation material to prevent heat exchange between the ice making compartment 60 and the refrigerating compartment 10.

An automatic ice making assembly 110 is provided at the ice making compartment 60 to generate ice. The automatic ice making assembly includes a refrigerant pipe fixing duct 111, which is configured to fix the refrigerant pipe 57 and form a portion of a cool air path at the inside the ice making compartment 60, the ice maker 100 to generate ice, and the ice bucket 200 to store the ice being generated from the ice maker 100.

The ice maker 100 includes the ice making tray 101 to generate ice by receiving water, an ejector configured to separate ice from the ice making tray 101, and an ice separating motor 102 to driving the ejector.

The ice bucket 200 may include an ice storage store 208 to store the ice, and an ice crushing space 204 formed at a front of the ice storage space 208 to crush the ice. The ice crushing space 204 may be formed at an inside the cover 203.

In addition, the ice bucket 200 may further include an auger 201 to deliver the ice from the ice storage space 208 to the ice crushing space 204. An auger motor assembly 300 may be provided at a rear of the ice bucket 200 to drive the auger 201. The auger motor assembly 300 may include an auger motor 301 which drives the auger 201. In addition, a solenoid driving apparatus 302 is provided at a front of the auger motor 301 to determine whether to crush the ice.

An ice bucket locking apparatus 400 is provide at a lower side of the ice making compartment 60 to prevent ice from being withdrawn to the outside the ice making compartment 60. Hereinafter, the ice bucket locking apparatus 400 will be described in detail.

Figure 3:
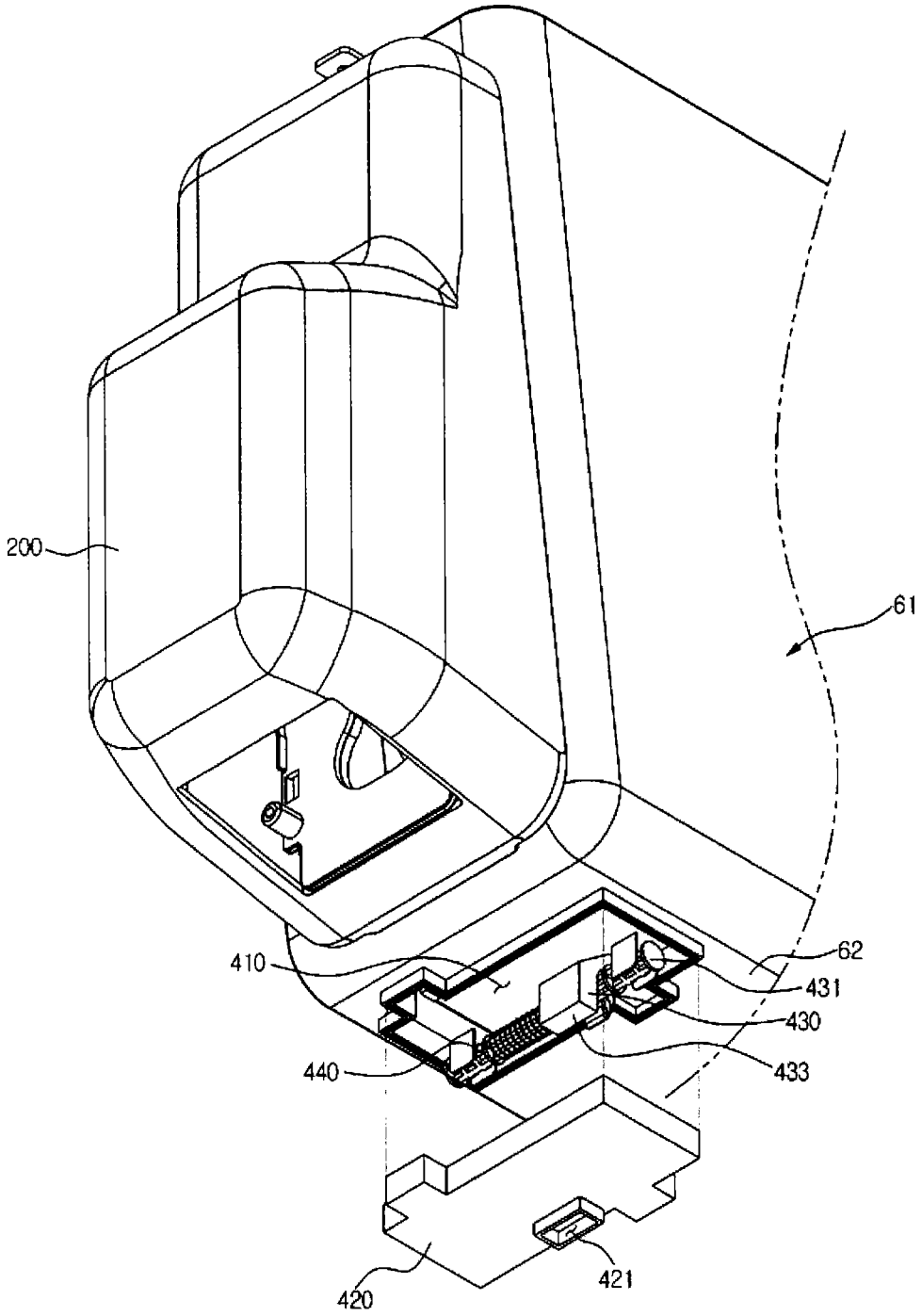
FIG. 3 is a view illustrating the interior of the refrigerator of FIG. 1 after separating a cover from an ice bucket locking apparatus.
Figure 4:
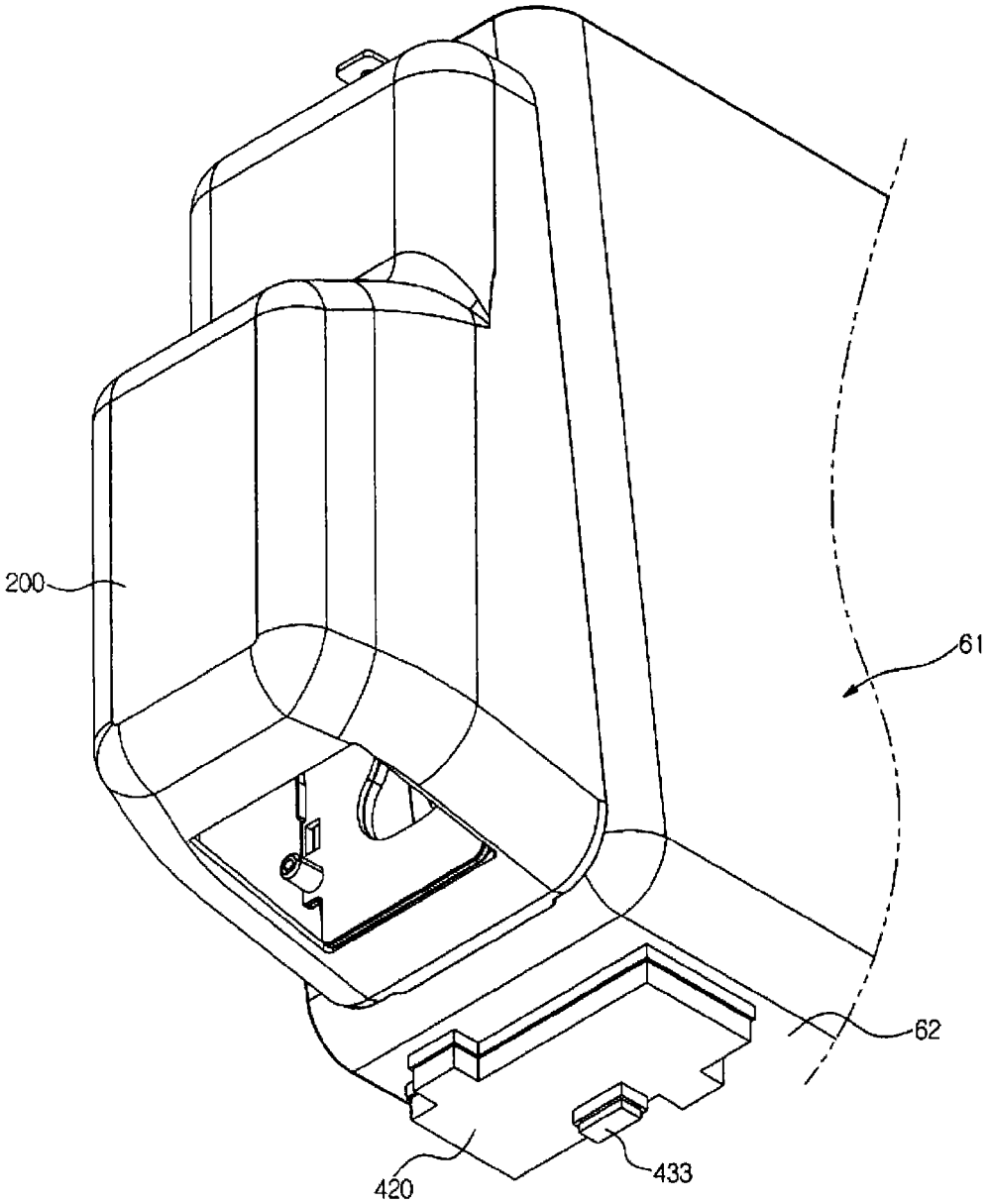
FIG. 4 is a view illustrating the external appearance of the ice bucket locking apparatus of the refrigerator of FIG. 1.
Figure 5:
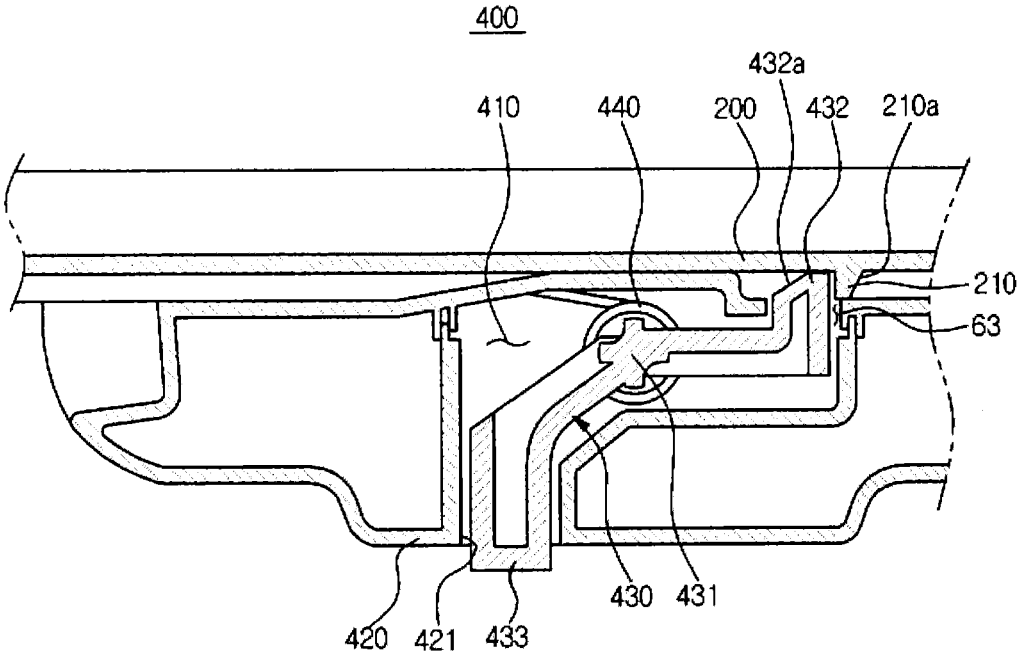
FIG. 5 is a cross sectional view illustrating the ice bucket locking apparatus of the refrigerator of FIG. 1 in a state that the ice bucket being is locked.
Figure 6:
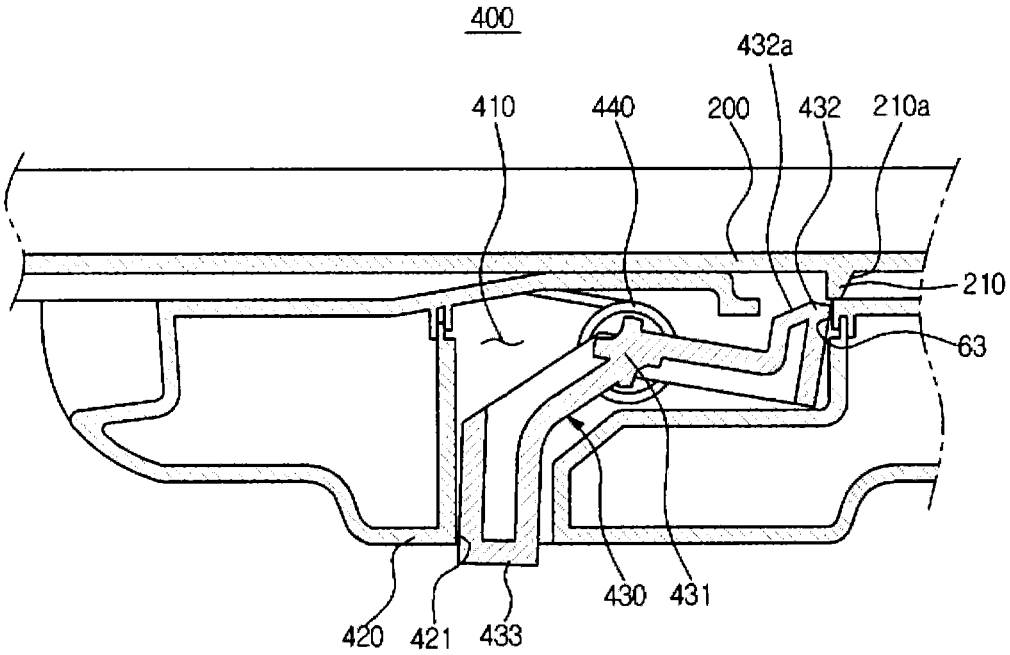
FIG. 6 is a cross sectional view illustrating the ice bucket locking apparatus of the refrigerator of FIG. 1 in a state that the ice bucket being is released.

FIG. 3 is a view illustrating the interior of the refrigerator of FIG. 1 after separating a cover from an ice bucket locking apparatus. FIG. 4 is a view illustrating the external appearance of the ice bucket locking apparatus of the refrigerator of FIG. 1. FIG. 5 is a cross sectional view illustrating the ice bucket locking apparatus of the refrigerator of FIG. 1 in a state that the ice bucket being is locked. FIG. 6 is a cross sectional view illustrating the ice bucket locking apparatus of the refrigerator of FIG. 1 in a state that the ice bucket being is released.

Referring to FIGS. 1 to 6, the ice bucket locking apparatus 400 includes a locking apparatus accommodating portion 410 that is provided at a lower side wall 62 of the ice making compartment 60 and has a lower surface configured to be open, a cover 420 coupled to the locking apparatus accommodating portion 410 to close the open lower surface of the locking apparatus accommodating portion 410, and a lever 430 accommodated in the locking apparatus accommodating portion 410.

The lever 430 is rotatably coupled to the locking apparatus accommodating portion 410 so as to rotate on a hinge shaft 431 that is provided at approximately a center portion of the lever 430. The lever 430 is provided at one end portion thereof with a locking protrusion 432 that is configured to interfere with a locking projection 210 formed on the lower portion of the ice bucket 200. The locking protrusion 432 may protrude to the outside the locking apparatus accommodating portion 410 by passing through an opening portion 63 formed on the lower side wall 62 of the ice making compartment.

In addition, the lever 430 is provided at the other end portion thereof with a button portion 433 configured to press the lever 430 such that the lever 430 is rotated on the hinge shaft 431. As the lever 430 rotates on the hinge shaft 431, the locking protrusion 432 of the lever 430 may be moved to a position at which the locking protrusion 432 is released from being locked with the locking projection 210 of the ice bucket 200.

The button portion 433 may be exposed to an outside of the cover 420 through an opening portion 421 formed on the cover 420 after the cover 420 is coupled to the locking apparatus accommodating potion 410.

In addition, a torsion spring 440 may be mounted on the hinge shaft 431 of the lever 430 such that the lever 430 is elastically biased to a position at which the locking protrusion 432 of the lever 430 interferes with the locking projection 210 of the ice bucket 200. Accordingly, as the pressure is not applied to the button portion 433, the locking protrusion 432 of the lever 430 is returned to the original position by the elastic force of the torsion spring 440 at which the locking protrusion 432 interferes with the locking projection.

The locking projection 210 of the ice bucket 200 and the locking protrusion 432 of the lever 430 may have inclination surfaces 210*a* and 432*a*, respectively, that slid against on each other such that the locking projection 210 is prevented from interfering with the locking protrusion 432 when the ice bucket 200 is inserted to the inside the ice making compartment 60.

As the ice bucket locking apparatus 400 is formed at a lower side of the ice making compartment 60, the structure of the ice bucket 200 is simplified when compared to a conventional case in which the locking apparatus is provided on the ice bucket.

Figure 7:
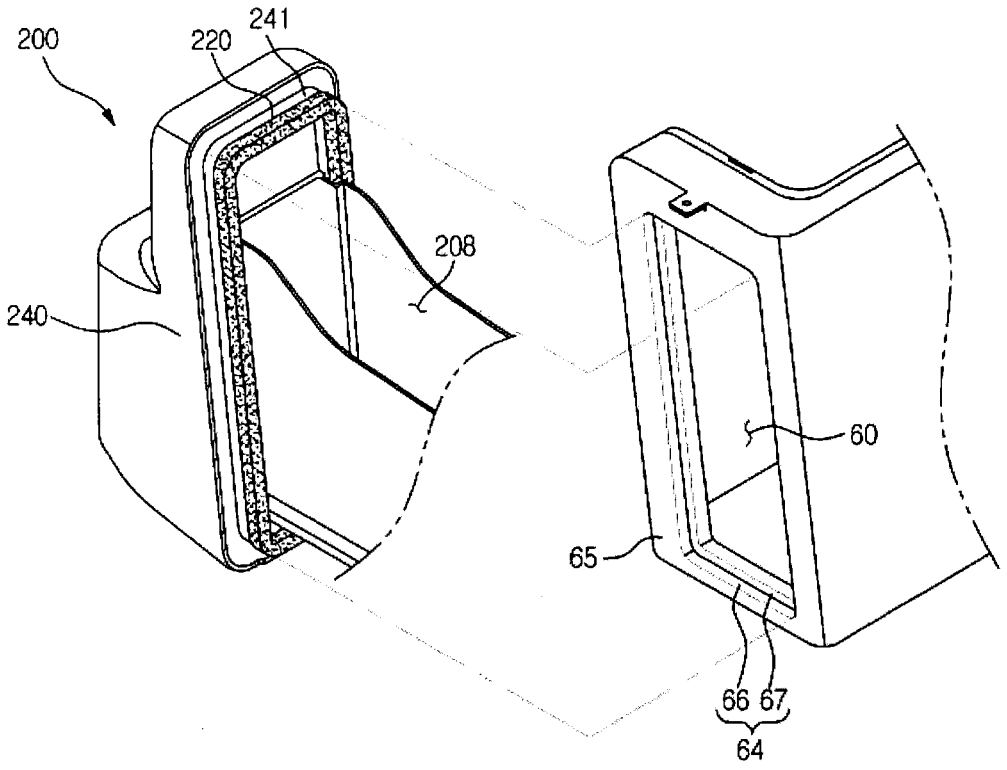
FIG. 7 is a perspective view illustrating a contact structure of an ice bucket gasket of the refrigerator of FIG. 1.
Figure 8:
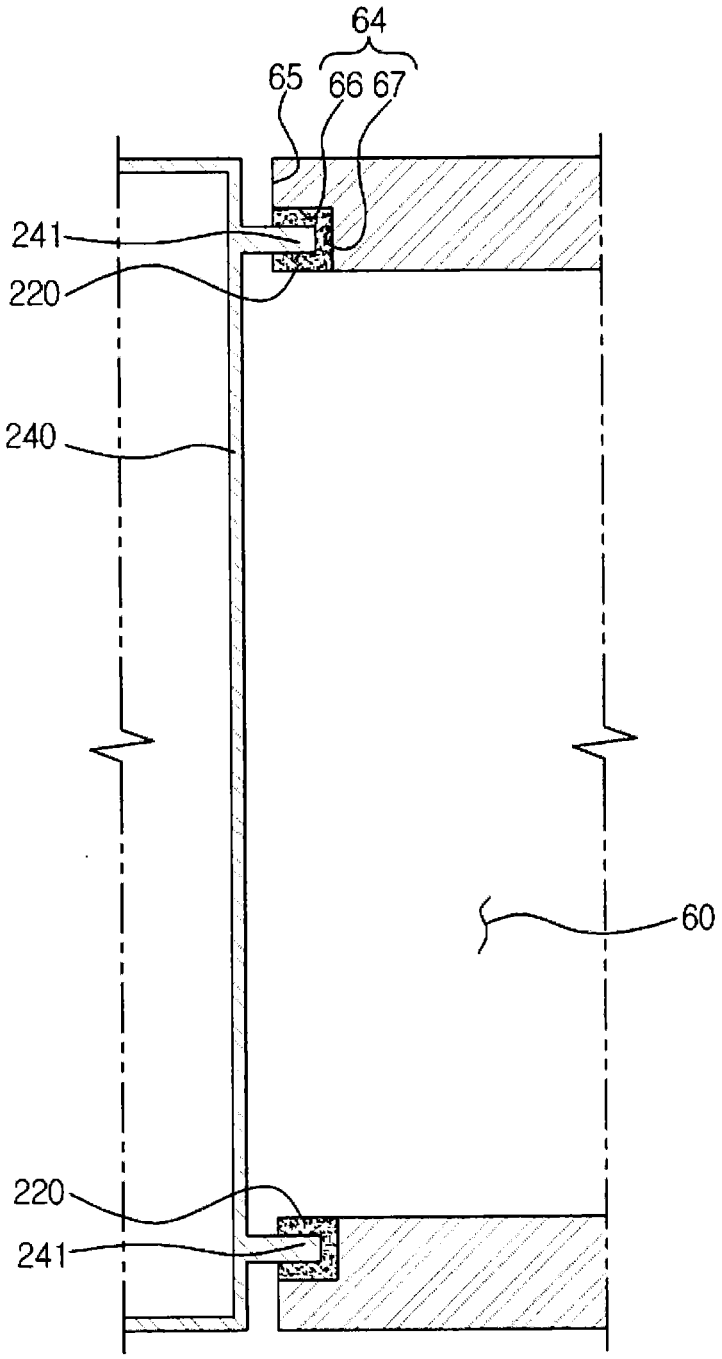
FIG. 8 is a cross sectional view illustrating a contact structure of an ice bucket gasket of the refrigerator of FIG. 1.

FIG. 7 is a perspective view illustrating a contact structure of an ice bucket gasket of the refrigerator of FIG. 1. FIG. 8 is a cross sectional view illustrating a contact structure of an ice bucket gasket of the refrigerator of FIG. 1.

Referring to FIGS. 7 and 8, the ice bucket 200 includes the ice making compartment cover portion 240 to cover the open front surface of the ice making compartment 60. The ice making compartment cover portion 240 may cover the open front surface of the ice making compartment 60 from the outside the ice making compartment 60. The ice making compartment cover portion 240 may be integrally formed with the ice storage space 208, which is provided at a front of the ice storage space 208.

A gasket 220 is provide at a rear surface of the ice making compartment cover portion 240 to seal the ice making compartment 60. The gasket 220 is mounted on a mounting protrusion 241, which protrudes from the rear surface of the ice making cover portion 240, in a manner to surround the mounting protrusion 241.

The ice making compartment 60 is provided at the open front surface thereof with a gasket mounting portion 64 on which the gasket 220 is mounted. The gasket mounting portion 64 is provided while extending from an outer surface 65 of the ice making compartment 60 to the inner side of the ice making compartment 60.

In addition, the gasket mounting portion 64 includes a first plane 66 that is bent from the outer surface 65 of the ice making compartment 60 to the inner side of the ice making compartment 60, and a second plane 67 that is bent from the first plane 66 and configured to a step with respect to the outer surface 65 of the ice making compartment 60.

Accordingly, the gasket 200 of the ice bucket 200 makes contact with both of the first plane 66 and the second plane 67 of the gasket mounting portion 64, thereby sealing the ice making compartment 60. Accordingly, the cool air of the ice making compartment 60 is prevented from leaking, and the ice bucket 200 is prevented from being shaken when the ice bucket 200 is mounted on the ice making compartment 60.

Although a few embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A refrigerator comprising:

a body;

a storage compartment provided at an inside the body;

an ice making compartment configured to be partitioned from the storage compartment at an inside the body, the ice making compartment provided at a front surface thereof with an opening portion;

an ice maker provided at an inside the ice making compartment to generate ice;

an ice bucket comprising an ice storage space configured to store the generated ice from the ice maker;

an ice making compartment cover portion configured to cover the opening portion of the ice making compartment, the ice making compartment cover portion provided at a rear surface thereof with a mounting protrusion;

a gasket provided at the mounting protrusion and configured to seal between the ice making compartment cover portion and the opening portion of the ice making compartment; and a gasket mounting portion, on which the gasket is mounted, is formed around the opening portion of the ice making compartment so that when the ice making compartment cover portion covers the ice making compartment, the gasket seals between the ice making compartment cover portion and the opening portion by making contacts with the gasket mounting portion in a two-area contact manner.

2. The refrigerator of claim 1, wherein the gasket mounting portion is configured to extend from an outer surface of the ice making compartment to an inner side of the ice making compartment.

3. The refrigerator of claim 2, wherein the gasket mounting portion comprises a first plane that is bent from the outer surface of the ice making compartment to the inner side of the ice making compartment, and a second plane that is bent from the first plane and configured to form a step with respect to the outer surface, wherein when the ice making compartment cover portion covers the ice making compartment, the gasket makes contact with the first plane and the second plane to seal between the ice making compartment cover portion and the opening portion in the two are contact manner.

4. The refrigerator of claim 1, wherein the gasket is mounted on the mounting protrusion so that a front portion of the mounting protrusion is enclosed by the gasket.

5. The refrigerator of claim 1, wherein the mounting protrusion has a front portion which is enclosed by the gasket and a rear portion that is not enclosed by the gasket so that the gasket seals between the ice making compartment cover portion and the opening portion by both the front portion and the rear portion.

6. The refrigerator of claim 1, wherein the ice making compartment cover portion is integrally formed with the ice bucket so that a front surface of the ice bucket is formed between inner sides of the mounting protrusion.

* * * * *